US005423946A

United States Patent [19]

Sarkar et al.

[11] Patent Number: 5,423,946

[45] Date of Patent: Jun. 13, 1995

[54] CATIONIC ANIONIC POLYELECTROLYTES FOR ENHANCING THE FREENESS OF PAPER PULP

[75] Inventors: Jawed M. Sarkar, Naperville; David R. Cosper, Downers Grove, both of Ill.

[73] Assignee: Nalco Chemical Company, Naperville, Ill.

[21] Appl. No.: 206,364

[22] Filed: Mar. 7, 1994

[51] Int. Cl.[6] ..... D21H 21/10

[52] U.S. Cl. ..... 162/158; 162/9; 162/72; 162/100; 162/168.2; 162/168.3; 162/182

[58] Field of Search ..... 162/72, 72 B, 9, 158, 162/168.2, 168.3, 100, 182

[56] References Cited

U.S. PATENT DOCUMENTS 4,923,565 5/1990 Fuentes et al. ..... 162/72 B 5,169,497 12/1992 Sakar et al. ..... 162/72 B

*Primary Examiner*—Peter Chin

*Attorney, Agent, or Firm*—Robert A. Miller; James J. Drake

[57] ABSTRACT

A process for improving the freeness of paper pulp, which comprises the steps of adding to the pulp at least 0.05%, based on the dry weight of the pulp, of a cellulolytic enzyme, allowing the pulp to contact the cellulolytic enzyme for from about 40 minutes to about 60 minutes at a temperature of at least 40° C., adding at least 0.011%, based on the dry weight of the pulp, of a water soluble cationic polymer, adding at least 0.007%, based on the dry weight of the pulp, of a water soluble anionic or nonionic polymer and forming the thus treated pulp into paper.

5 Claims, 11 Drawing Sheets

CATIONIC ANIONIC POLYELECTROLYTES FOR ENHANCING THE FREENESS OF PAPER PULP

BACKGROUND OF THE INVENTION

1. Field of the Invention

The invention relates to a combination of cellulolytic enzymes with cationic and anionic polymers for use in enhancing the freeness of paper pulp.

2. Description of the Prior Art

More and more the papermaking industry uses recycled papers. For example, for the manufacture of corrugated cardboard, raw materials which are based on recycled fibers are being used more frequently and, at the same time, the number of recyclings is increased. With each recycling, the quality of the raw materials is lessened. To obtain a satisfactory level of raw material quality, refining of the pulps in aqueous suspension is generally carried out. This refining leads to difficulties in runnability of the paper sheet because of high concentrations of fines and other contaminants which may be found in the refined pulp.

The pulps in aqueous suspension which are ready to be used on a paper machine can be characterized by various parameters, one of which is particularly significant for predicting the draining capability of the pulp. A measure of the drainability of the pulp is frequently expressed in the term "freeness". Specifically, freeness is measured according to Canadian Standard Freeness, or CSF measurement. CSF measures the drainage of 3 grams (oven dried weight) of pulp suspended in one liter of water.

Use of cellulolytic enzymes, e.g. the cellulases and/or the hemicellulases for treating recycled paper pulps to improve freeness is the subject of U.S. Pat. No. 4,923,565 the disclosure of which is incorporated herein by reference. The cellulase enzyme described in the '565 patent may be used in the practice of the present invention.

U.S. Pat. No. 5,169,497, issued to Sarkar and Cosper discussed the effects of cellulases in combination with cationic flocculants of varying composition on the freeness of old corrugated containers (OCC) pulp. The '497 patent covers the use of a combination of enzyme and cationic polymers for enhancing the freeness of recycled fiber. In practice, dual polymer treatment programs are also used for retention.

In a dual polymer retention system, two synthetic polymers are mixed with the pulp sequentially to achieve better results than obtained with either polymer by itself. Usually, a low molecular weight, highly charged cationic polymer is added to the papermaking furnish first, and then at a later stage, a high molecular weight, anionic polymer is added. Dual polymers have found a place in paper and board manufacturing. Good retention has numerous economic benefits. As the use of recycled fiber increases in container board, fine paper, and newsprint grades, the opportunity to provide benefits through retention aids has also increased. If fines are not retained by a good retention aid or hydrolyzed by an enzyme, they will impede drainage, fill felts, and cause deposition problems. The key benefit of retention aids with enzyme is to prevent drainage reduction and subsequent loss of machine speed. Drainage can be maintained by preventing the build-up of fines in the white water loop.

While the present invention produces particularly good results when used to treat pulps which contain substantial quantities of recycled fibers, it also has applicability in treating pulps which contain little or no recycled fibers.

SUMMARY OF THE INVENTION

A process for improving the freeness of paper pulp, which comprises the steps of adding to the pulp at least 0.05%, based on the dry weight of the pulp, of a cellulolytic enzyme, allowing the pulp to contact the cellulolytic enzyme for from about 40 minutes to about 60 minutes at a temperature of at least 40° C., adding at least 0.011%, based on the dry weight of the pulp, of a water soluble cationic polymer, adding at least 0.007%, based on the dry weight of the pulp, of a water soluble anionic polymer and forming the thus treated pulp into paper.

DESCRIPTION OF THE PREFERRED EMBODIMENTS

Figure 1:
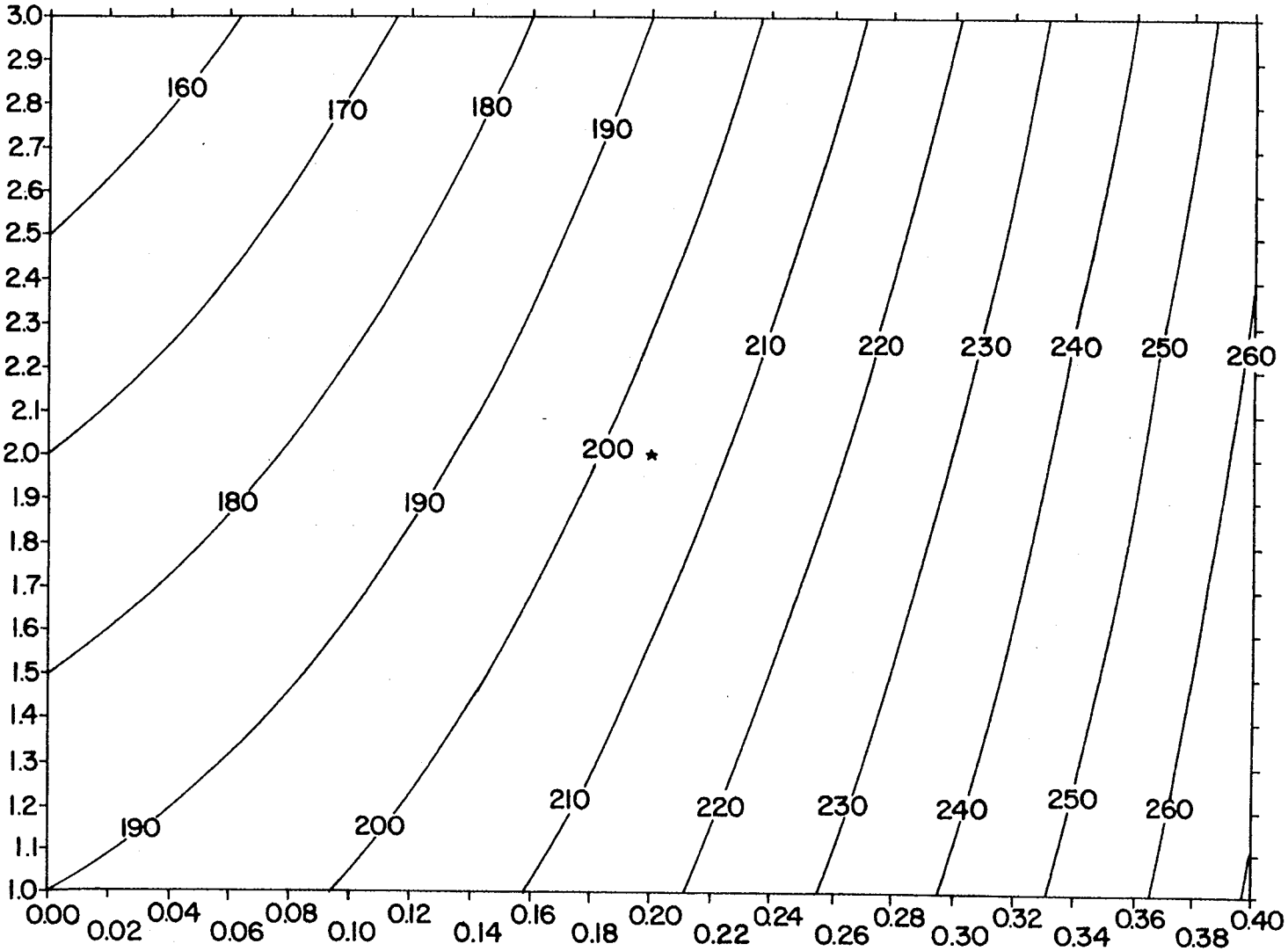
FIG. 1, is a statistical analysis of the freeness changes of anionic polymer A.

A variety of water soluble cationic coagulants may be used in the practice of the invention. Both condensation and vinyl addition polymers may be employed. For a list of water soluble cationic polymers, reference may be had to Canadian patent 731,212, the disclosure of which is incorporated herein by reference.

A preferred group of cationic polymers are the cationic polymers of acrylamide which in a more preferred embodiment of the invention, contain form 40–60% by weight of acrylamide. Larger or smaller amounts of acrylamide in the polymers may be used, e.g., between 30–80%. Typical of the cationic monomers, polymerized with acrylamide are the monomers diallyldimethyl ammonium chloride, (DADMAC), dimethylaminoethyl/acrylate methyl chloride quaternary ammonium salt, (DMAEA.MCQ). When these cationic acrylamide polymers are used they should have a RSV (reduced specific viscosity) of at least 3 and preferably the RSV should be within the range of 5–20 or more. RSV was determined using a one molar sodium nitrate solution at 30° C. The concentration of the acrylamide polymer in this solution is 0.045%.

A preferred group of anionic polymers are polymers of acrylamide containing 20–95% acrylamide and 5 to 80% anionic monomer by weight of the polymer such as acrylic acid or methacrylic acid.

As indicated, the invention has utility in improving the drainage or the freeness of a wide variety of paper pulps, including Kraft and other types of pulp. The invention is particularly useful in treating pulps that contain recycled fibers. The effectiveness of the invention in improving drainage is most notable when the pulps contain at least 10 percent by weight of recycled fiber, with great improvements being evidenced when the recycled fiber content or the pulp being treated is at least 50% or more.

As indicated, the invention requires that the pulp first be treated with an enzyme, then with a cationic polymer and, finally, with an anionic polymer. It is also important to the successful practice of the invention, that the conditions under which the treatment with the enzyme occurs is such to provide optimum reaction time of the enzyme of the pulp.

The treatment of the pulp with the enzyme is preferably conducted for a period of time not greater than 60 minutes. The minimum treating time is about 30 minutes. A typical treating time would be about 40 minutes. The pH of the pulp to achieve optimum results should be between the ranges of 5 to 7.5. The temperature of the treatment should not be below 20° C., and usually should not exceed 60° C. A typical average reaction temperature is favorably conducted is 40° C.

The preferred dosage of the cationic polymer, as actives, is from 0.025% to 0.02% polymer based on the dry weight of the pulp. A general dosage which may be used to treat the pulp with the polymer is from 0.01% to 0.08% by weight of the polymer. The preferred dosage of anionic polymer, as actives, is 0.025%–0.075% polymer based on the dry weight of the pulp.

The enzyme dosage based on the dry weight of the pulp in a preferred embodiment ranges from about 0.05 to about 0.4 percent by weight. A general treatment range of the enzyme that may be used is from 0.01 to 0.5 percent by weight.

In order for the enzyme to have sufficient reaction time and mixing described above, it is necessary that they be added to the pulp at the point in the paper making system to allow sufficient time for the above conditions to occur. Thus, a typical addition point in paper making system would be the machine chest. Other places where suitable contact time would occur may also be used as additional points.

Since pulp slurry is not homogeneous, it is difficult to take an exact required weight of pulp equivalent to 3 grams. Therefore, at the time of freeness testing, with respect to the data hereafter presented, the consistency of pulp stock was determined by stirring well and then drained in a Buchner funnel. The pulp pad was dried at 105° C. to determine the exact weight of the pad. The CSF data hereafter, reported was corrected to a 0.3% consistency using the table of freeness corrections prepared by the pulp and paper Research Institute of Canada and has been described in TAPPI manual (T227). The CSF values were measured at 20° C.

The following examples are presented to describe preferred embodiments and utilities of the invention and are not meant to limit the invention unless otherwise stated in the claims appended hereto.

EXAMPLE 1

Figure 2:
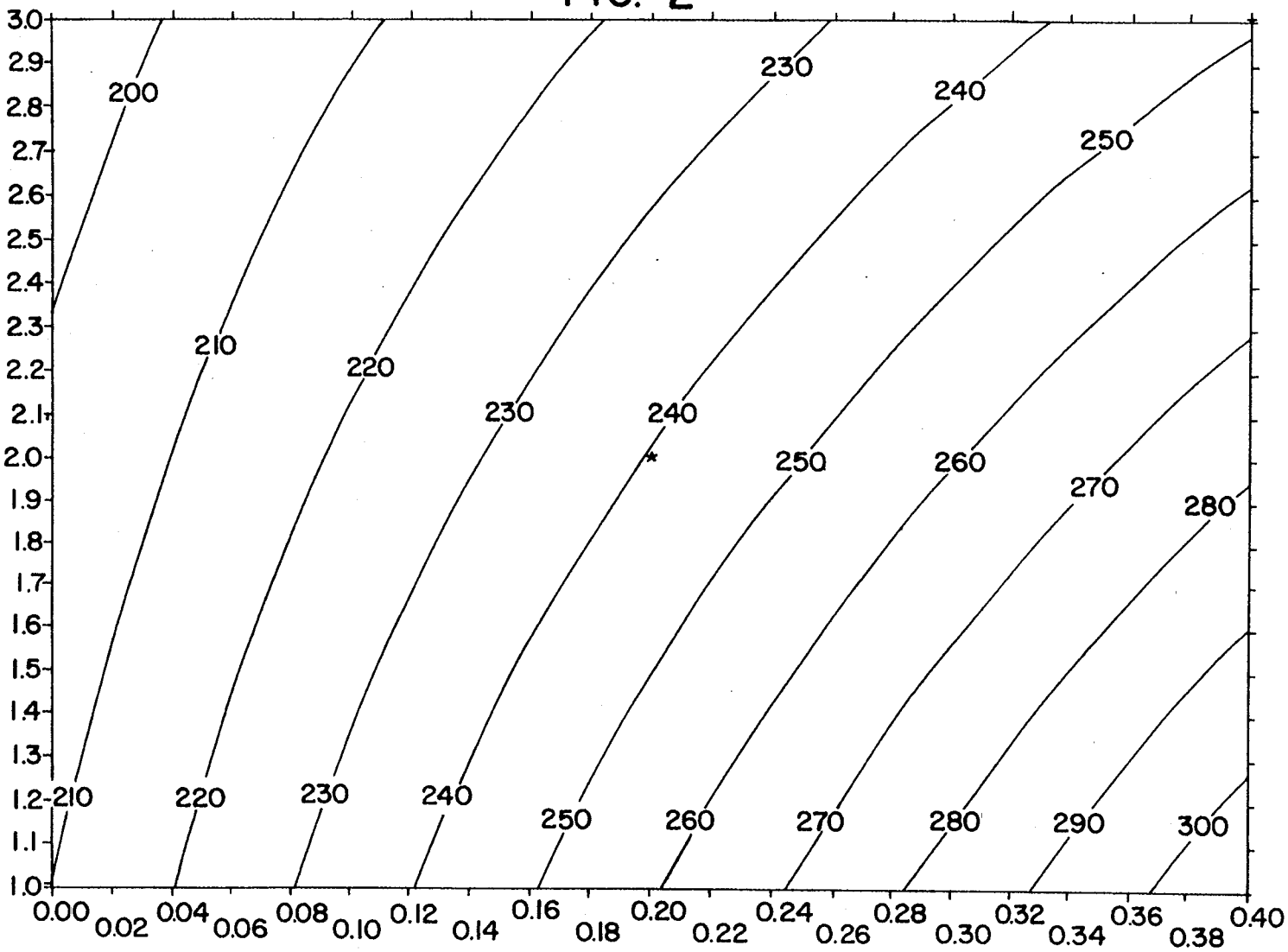
FIG. 2, is a statistical analysis of the freeness changes of anionic polymer B.

An 18 run response surface design (Table I), in which the effects of enzyme dose, polymer dose and polymer type (Artionic A and Anionic B) on the freeness of pulp were investigated. The pulp slurry consistency of 2.3% (3 g dry wt.), which had a pH 5.6, was first treated for 60 minutes at 40° C. under continuous agitation (250 rpm) with an enzyme solution containing Liftase-A40 (0 to 0.4% based on dry wt. of pulp), and then treated separately for 1 minute with different polymers. The freeness values using only Liftase A40 (0.2 and 0.4% wt./wt basis) were increased from 220 mL (untreated) to 320 and 376 mL, respectively. When Liftase A40 pretreated pulp was further treated with anionic polymers, the freeness of pulp decreased (Table I). Statistical analysis of the data revealed (FIGS. 1 and 2) that in the case of anionic flocculants (Anionic A and Anionic B), the decrease in freeness was almost linear with the increase in flocculant concentration. The freeness of pulp untreated with enzyme was decreased by anionic flocculants (Table I).

TABLE I

EXPERIMENTAL DESIGN LIFTASE-ANIONIC POLYMERS

| RUNS | POLYMERS TESTED | POLYMER DOSE* | ENZYME DOSE** | RUN ORDER | FREENESS ML (CSF) |
|---|---|---|---|---|---|
| 1 | Anionic A Acrylamide/Acrylic Acid Copolymers | 1 | 0 | 23 | 190 |
| 2 | Anionic A Acrylamide/Acrylic Acid Copolymers | 3 | 0 | 25 | 150 |
| 3 | Anionic A Acrylamide/Acrylic Acid Copolymers | 2 | .2 | 14 | 200 |
| 4 | Anionic A Acrylamide/Acrylic Acid Copolymers | 2 | .2 | 18 | 205 |
| 5 | Anionic A Acrylamide/Acrylic Acid Copolymers | 2 | .2 | 13 | 207 |
| 6 | Anionic A Acrylamide/Acrylic Acid Copolymers | 1 | .4 | 6 | 271 |
| 7 | Anionic A Acrylamide/Acrylic Acid Copolymers | 3 | .4 | 21 | 255 |
| 8 | Anionic B Acrylamide/Acrylic Acid Copolymers | 1 | 0 | 4 | 210 |
| 9 | Anionic B Acrylamide/Acrylic Acid Copolymers | 3 | 0 | 22 | 195 |
| 10 | Anionic B Acrylamide/Acrylic Acid Copolymers | 2 | .2 | 12 | 242 |
| 11 | Anionic B Acrylamide/Acrylic Acid | 2 | .2 | 16 | 240 |

TABLE I-continued

| EXPERIMENTAL DESIGN LIFTASE-ANIONIC POLYMERS | | | | | |
|---|---|---|---|---|---|
| RUNS | POLYMERS TESTED | POLYMER DOSE* | ENZYME DOSE** | RUN ORDER | FREENESS ML (CSF) |
| | Copolymers | | | | |
| 12 | Anionic B Acrylamide/Acrylic Acid Copolymers | 2 | .2 | 19 | 240 |
| 13 | Anionic B Acrylamide/Acrylic Acid Copolymers | 1 | .4 | 2 | 308 |
| 14 | Anionic B Acrylamide/Acrylic Acid Copolymers | 3 | .4 | 2 | 249 |
| 15 | — | 0 | 0 | 7 | 220 |
| 16 | — | 0 | .2 | 3 | 320 |
| 17 | — | 0 | .2 | 11 | 323 |
| 18 | — | 0 | .4 | 24 | 376 |

DOSE* = POUNDS PRODUCT/TON DRY PULP
DOSE** = LIQUID PREPARATION ON DRY WEIGHT BASIS OF PULP

Results obtained using anionic flocculants are in contrast with previous results obtained using cationic flocculants. These results suggest that the anionic flocculants tested were not adsorbed on the fiber and they might have simply remained in the solution. Lack of adsorption of these flocculants on the fiber and consequent high viscosity of the pulp slurry, due to the presence of polymer, might be responsible for the decrease in freeness.

EXAMPLE 2

A 15 run response surface design (Table II) was performed in which the effect of a cationic (Cationic A) polymer followed by an anionic (Anionic B) polymer, in the presence and in the absence of Liftase A40, on the freeness of pulp was investigated. The pulp slurry of 2.3% consistency (3 g. dry weight) was first treated for 60 min. at 40° C. under continuous agitation (250 rpm) with an enzyme solution containing Liftase-A40 (0 to 0.4% based on dry weight of pulp), and then treated sequentially for 2.0 min. with different concentrations of Cationic A (0.2 to 2.0 pounds polymer as product actives/ton dry pulp) and Anionic B (0.28 0.84 pounds polymer as product actives/ton dry pulp). In many applications, 1 to 3 pounds of Cationic A as product are used. A higher dose (4.5 pounds) of Cationic A was tested since a colloid titration of the pulp revealed that $4.5\times10^3$ g of Cationic A polymer was required to satisfy the cationic demand of 3 g. (dry wt.) pulp used in this study. The freeness of the pulp decreased when treated with the anionic polymer alone, whereas the freeness increased when treated with the cationic polymer alone. It appears that the negative charges on the fiber prevent the adsorption of anionic polymers which remain solution.

Interestingly, with a sequential treatment of cationic and anionic polymers, the freeness of pulp was increased dramatically and a positive interaction between the two polymers has been found, particularly at high dosages of both polymers. Although a maximum increase in freeness may be achieved using high dosages of cationic and anionic polymers without enzyme, these unrealistically high dosages of polymers may be detrimental to the strength and the formation of the sheet.

TABLE II

| EXPERIMENTAL DESIGN: LIFTASE TESTED WITH CATIONIC & ANIONIC POLYMERS | | | | | |
|---|---|---|---|---|---|
| RUNS | CAT: CATIONIC A DOSE* | AN: ANIONIC DOSE** | ENZYME DOSE *** | RUN ORDER | FREENESS ML (CSF) |
| 1 | 0.5 | 1 | .2 | 12 | 268 |
| 2 | 4.5 | 1 | .2 | 14 | 435 |
| 3 | 0.5 | 3 | .2 | 2 | 273 |
| 4 | 4.5 | 3 | .2 | 17 | 608 |
| 5 | 0.5 | 1 | .4 | 11 | 338 |
| 6 | 4.5 | 1 | .4 | 7 | 475 |
| 7 | 0.5 | 3 | .4 | 4 | 285 |
| 8 | 4.5 | 3 | .4 | 8 | 623 |
| 9 | 2.5 | 2 | .3 | 5 | 317 |
| 10 | 2.5 | 2 | .3 | 9 | 322 |
| 11 | 2.5 | 2 | .3 | 1 | 318 |
| 12 | 0 | 0 | 0 | 6 | 222 |
| 13 | 2.5 | 0 | 0 | 3 | 236 |
| 14 | 0 | 2 | 0 | 10 | 190 |
| 15 | 0 | 0 | .3 | 15 | 342 |

* = CATIONIC A DOSE (POUNDS PRODUCT/TON DRY PULP
** = ANIONIC DOSE (POUNDS PRODUCT/TON DRY PULP
*** = % LIFTASE DOSE ON DRY WT. BASIS OF PULP

EXAMPLE 3

In order to confirm the positive interaction of cationic and anionic polymers another experimental design was carried out, where the interactions between lower dosages of polymers in the presence and in the absence of enzyme were investigated.

A 10 run response surface design (Table III) was carried out.

TABLE III

| LIFTASE TESTED WITH DUAL POLYMER | | | | | |
|---|---|---|---|---|---|
| RUNS | CATIONIC A DOSE* | ANIONIC B DOSE** | ENZYME DOSE** | RUN ORDER | FREENESS ML (CSF) |
| 1 | 0.5 | 0.5 | .10 | 3 | 282 |
| 2 | 3.0 | 0.5 | .10 | 4 | 455 |
| 3 | 0.5 | 3.0 | .10 | 8 | 240 |
| 4 | 3.0 | 3.0 | .10 | 6 | 597 |

TABLE III-continued

| LIFTASE TESTED WITH DUAL POLYMER | | | | | |
|---|---|---|---|---|---|
| RUNS | CATIONIC A DOSE* | ANIONIC B DOSE** | ENZYME DOSE** | RUN ORDER | FREENESS ML (CSF) |
| 5 | 0.5 | 0.5 | .40 | 7 | 365 |
| 6 | 3.0 | 0.5 | .40 | 1 | 497 |
| 7 | 0.5 | 3.0 | .40 | 10 | 323 |
| 8 | 3.0 | 3.0 | .40 | 2 | 662 |
| 9 | 1.8 | 1.8 | .25 | 9 | 405 |
| 10 | 1.8 | 1.8 | .25 | 5 | 410 |

* = CATIONIC A AND ANIONIC B DOSE (POUNDS PRODUCT/TON DRY PULP)
** = LIFTASE DOSE (% BASED ON DRY WT. OF PULP)

*** = LIFTASE DOSE ON DRY WT. BASIS OF PULP

In this experiment, the effects of cationic (Cationic A) and anionic (Anionic B) polymers ranging from 0.22–1.33 pounds active/ton dry pulp (Cationic) and 0.14–0.84 pounds active/ton dry pulp (Anionic) in the presence and in the absence of Liftase A40, on the freeness of pulp was investigated. The pulp slurry and all the experimental conditions were similar to those described in Examples 1 and 2. In this experiment, the main effects of cationic and anionic polymers and enzyme were separately calculated using their low and high dosages over the entire combinations used in this experimental design. The results show that the presence of high dose of cationic polymer played a more dominant role in the increase of freeness (553 ml) than played by enzyme (462 ml) and anionic polymer (455 ml). Interactions between cationic and annionic polymers, cationic polymer and enzyme, and anionic polymer and enzyme were also investigated. A positive strong interaction has been found between cationic and anionic polymers. As found earlier, the cationic polymer played an important role in enhancing the freeness of pulp. In contrast, anionic polymer alone decreased the freeness. It is therefore important to use either high dosages of both cationic and anionic polymers or, if a low dose of cationic polymer is required, then the anionic polymer dose should also be kept low. A weak interaction has been found between cationic polymer and enzyme. No interaction has been found between anionic polymer and enzyme.

TABLE IV

| | Least Squares Coefficients, Response CSF, Model | | | |
|---|---|---|---|---|
| 0 Term | 1 Coeff. | 2 Std. Error | 3 T-Value | 4 Signif. |
| 1 1 | 401.259615 | 4.442421 | 90.32 | 0.0001 |
| 2 ~C | 125.125000 | 2.216768 | 56.44 | 0.0003 |
| 3 ~A | 27.875000 | 2.216768 | 12.57 | 0.0063 |
| 4 ~E | 34.125000 | 2.216768 | 15.39 | 0.0042 |
| 5 ~C*A | 48.875000 | 2.216768 | 22.05 | 0.0021 |
| 6 ~C*E | −7.375000 | 2.216768 | −3.33 | 0.0797 |
| 7 ~A*E | 2.875000 | 2.216768 | 1.30 | 0.3241 |
| 8 CURVATURE | 26.365385 | 4.966378 | 5.31 | 0.0337 |

| 0 Term | 5 Transformed Term |
|---|---|
| 1 1 | |
| 2 ~C | ((C-1.75)/1.25) |
| 3 ~A | ((A-1.75)/1.25) |
| 4 ~E | ((E-2.5e-01)/1.5e-01) |
| 5 ~C*A | ((C-1.75)/1.25)*((A-1.75 |
| 6 ~C*E | ((C-1.75)/1.25)*((E-2.5e |
| 7 ~A*E | ((A-1.75)/1.25)*((E-2.5e |
| 8 CURVA | ((C-1.75)/1.25)**2 |

No. cases = 10
R-sq. = 0.9995
RMS Error = 6.27
Resid. df = 2
R-sq-adj. = 0.9978
Cond. No. = 4.246
~ indicates factors are transformed.

Figure 3:
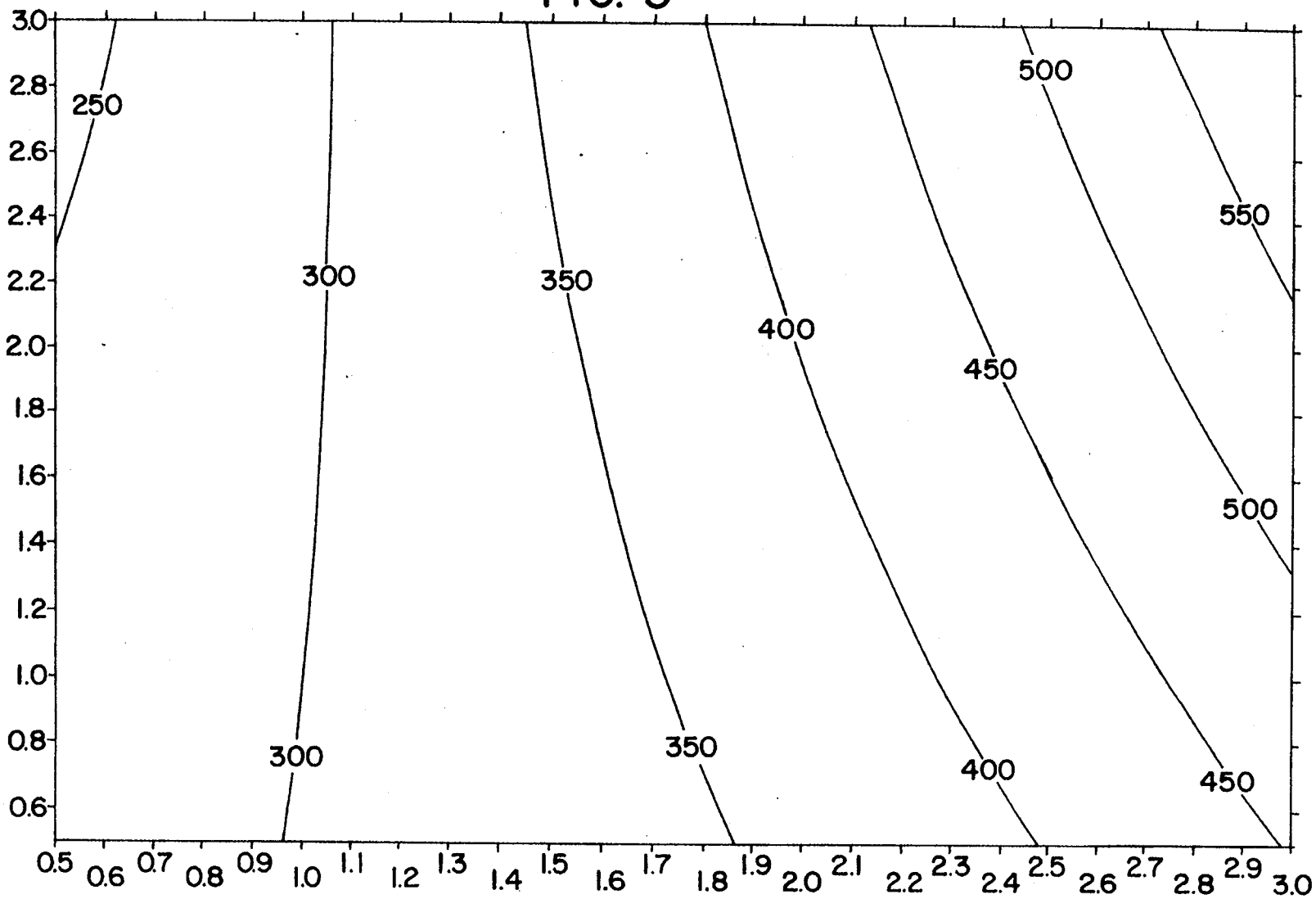
FIG. 3, is a contour plot showing the increase in freeness that you use to buy an enzyme dosage of 0.1 percent.
Figure 4:
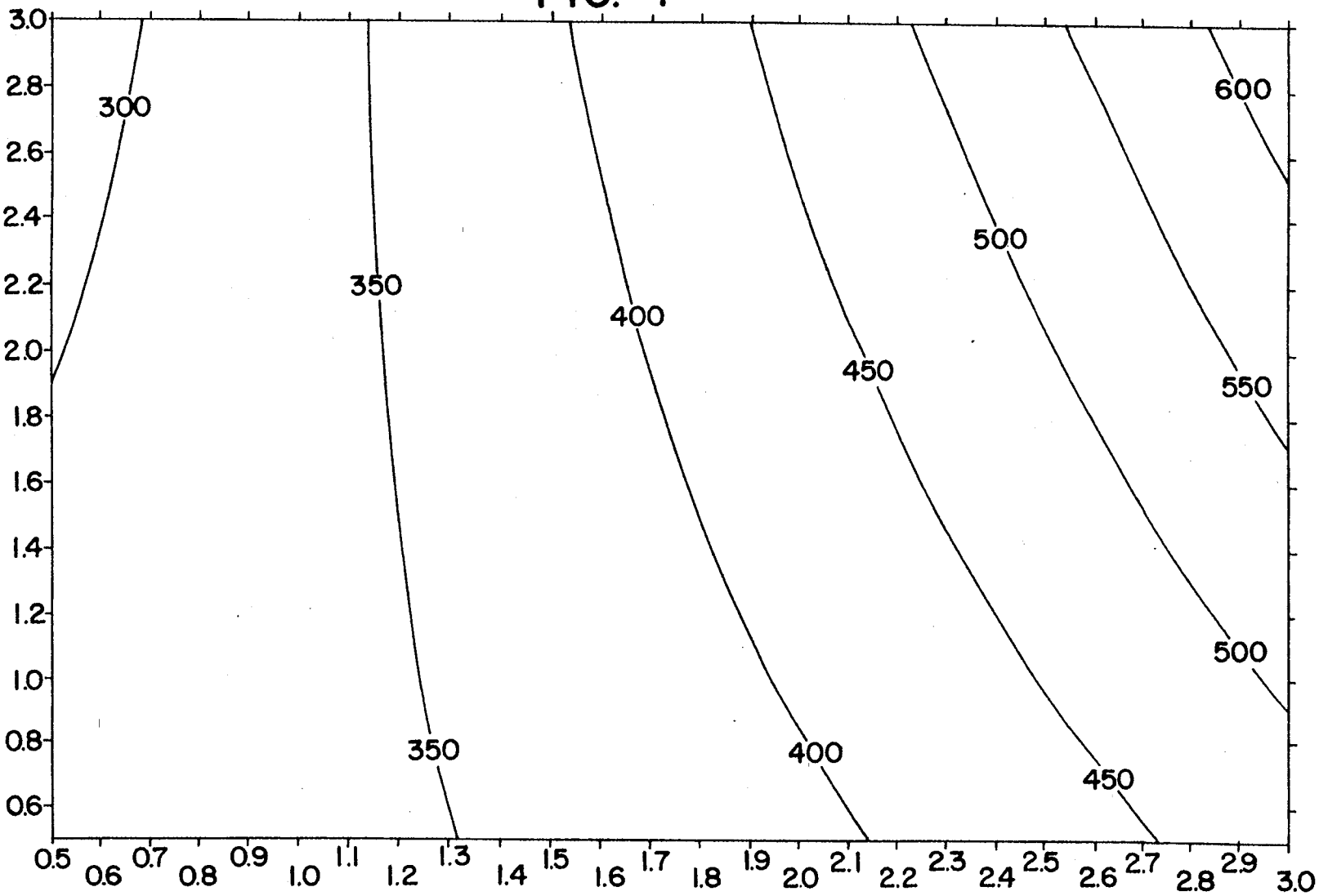
FIG. 4, is a contour plot showing the increase in freeness that you use to buy enzyme of 0.25 percent.
Figure 5:
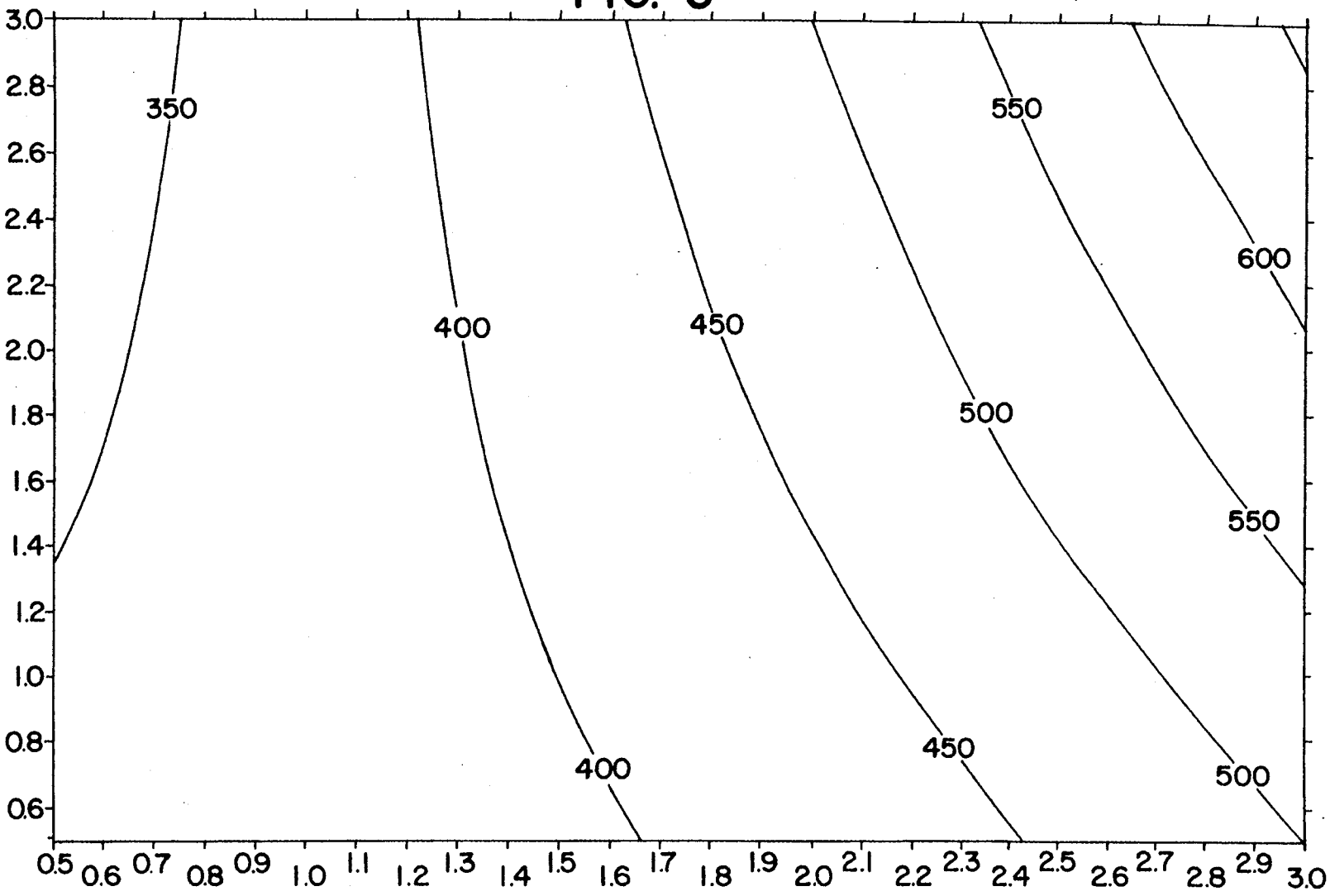
FIG. 5, is a contour plot showing the increase in freeness that you use to buy enzyme of 0.4 percent.

The experimental data given in Table V was used to develop a predictive equation which was used to generate contour plots (FIGS. 3, 4, and 5). It is clearly shown (FIGS. 3, 4, and 5) that by increasing the enzyme dose from 0.1 to 0.4% the freeness increased and the shape of the curves of response surface changed. A dual polymer program with enzyme may be beneficial if the dosages level of polymers are correctly determined.

EXAMPLE 4

In order to broaden the scope of this investigation other cationic polymers such as poly-DADMAC (poly-DADMAC cationics) EDC-ammonia (EDC-Anionic/-cationics) with an anionic (Anionic B) polymer in the presence of Liftase-A40 were also examined.

Experiments of a six run and a twelve run response surface design were carried out (Tables V and VI).

TABLE V

| 0 | 1 RUN ORDER | 2 CATIONIC-TYPE | 3 CATIONIC-DOSE | 4 ANIONIC-DOSE | 5 NET-FREENESS |
|---|---|---|---|---|---|
| 1 | 3 | CATIONIC A | 0.50 | 0.50 | 266 |
| 2 | 4 | CATIONIC A | 1.75 | 1.75 | 382 |
| 3 | 6 | CATIONIC A | 0.50 | 3.00 | 226 |
| 4 | 11 | CATIONIC A | 3.00 | 0.50 | 455 |
| 5 | 12 | CATIONIC A | 3.00 | 3.00 | 642 |
| 6 | 17 | CATIONIC A | 1.75 | 1.75 | 387 |

TABLE VI

| 0 | 1 ORD | 2 CATIONIC-TYPE | 3 CATIONIC-DOSE | 4 ANIONIC-DOSE | 5 NET-FREENESS |
|---|---|---|---|---|---|
| 1 | 1 | CATIONIC B | 1.75 | 1.75 | 252 |

TABLE VI-continued

| 0 | 1 ORD | 2 CATIONIC-TYPE | 3 CATIONIC-DOSE | 4 ANIONIC-DOSE | 5 NET-FREENESS |
|---|---|---|---|---|---|
| 2 | 2 | CATIONIC C (EDC-AMMONIA) | 0.50 | 0.50 | 266 |
| 3 | 5 | CATIONIC B | 0.50 | 3.00 | 227 |
| 4 | 7 | CATIONIC B | 3.00 | 0.50 | 279 |
| 5 | 8 | CATIONIC C (EDC-AMMONIA) | 1.75 | 1.75 | 245 |
| 6 | 9 | CATIONIC C (EDC-AMMONIA) | 0.50 | 3.00 | 224 |
| 7 | 10 | CATIONIC C (EDC-AMMONIA) | 3.00 | 0.50 | 258 |
| 8 | 13 | CATIONIC C (EDC-AMMONIA) | 3.00 | 3.00 | 240 |
| 9 | 14 | CATIONIC B | 3.00 | 3.00 | 250 |
| 10 | 15 | CATIONIC C (EDC-AMMONIA) | 1.75 | 1.75 | 248 |
| 11 | 16 | CATIONIC B | 0.50 | 0.50 | 282 |
| 12 | 18 | CATIONIC B | 1.75 | 1.75 | 256 |

The effect of cationic polymer Cationic A, was studied in the six-run design. Cationic polymers, poly-DADMAC B and EDC - ammonia C were studied using the twelve run design. Both experiments were run with an anionic polymer (Anionic B) in the presence of Liftase-A40 and the pulp freeness was measured. In each case the pulp slurry was first treated under optimal conditions with Liftase-A40 (0.2% based on dry weight of pulp), and then treated sequentially for 2.0 min. at 20° C. with different dosages of cationic polymers (0.5 to 3 pounds polymer as product/ton dry pulp) and an anionic polymer (0.5 to 3.0 pounds polymer as product/ton dry pulp).

Figure 6:
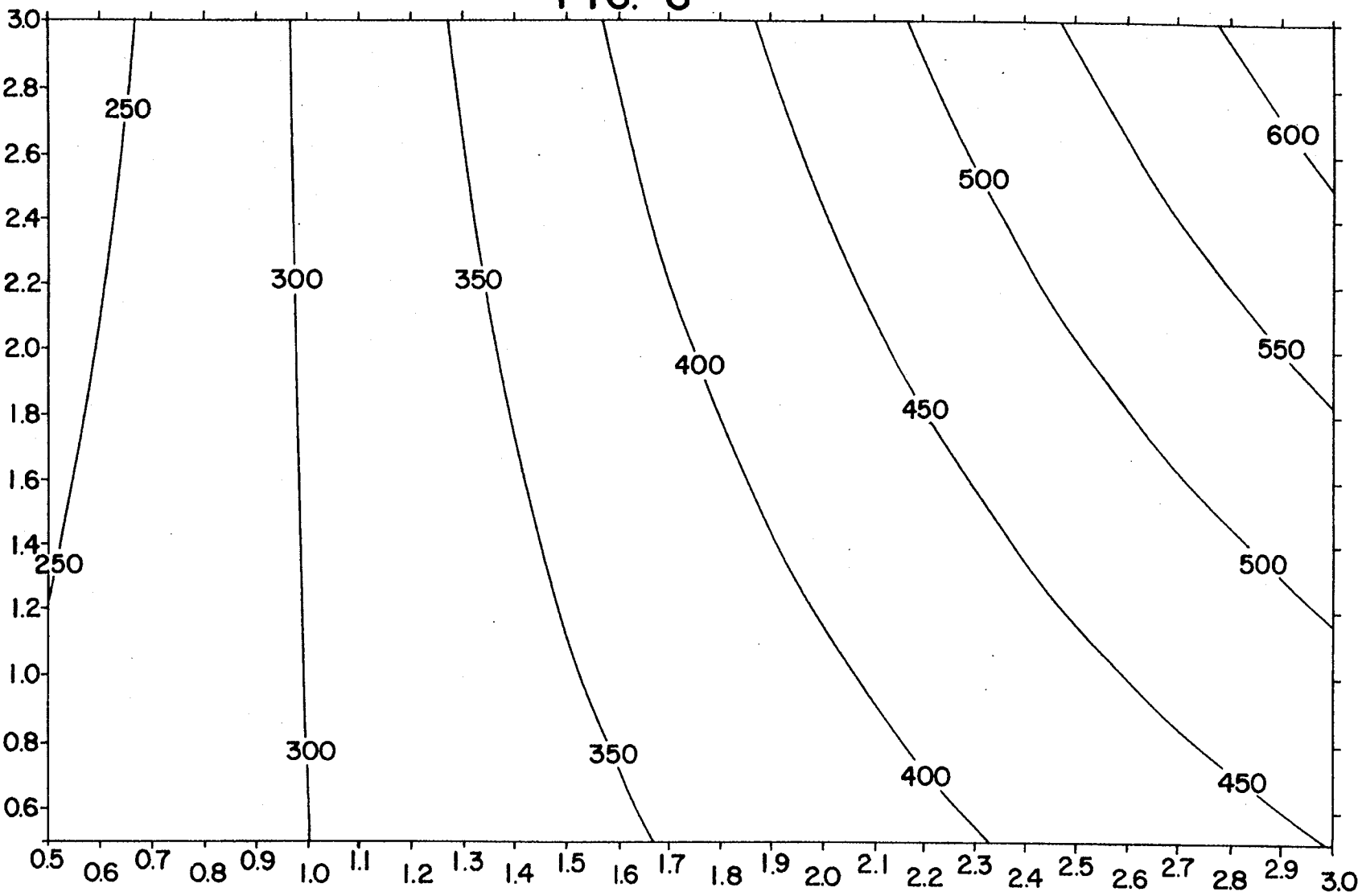
FIG. 6, is a contour plot showing the increase in freeness achieved by a combination of Cationic A, Anionic B and liftase A40.
Figure 7:
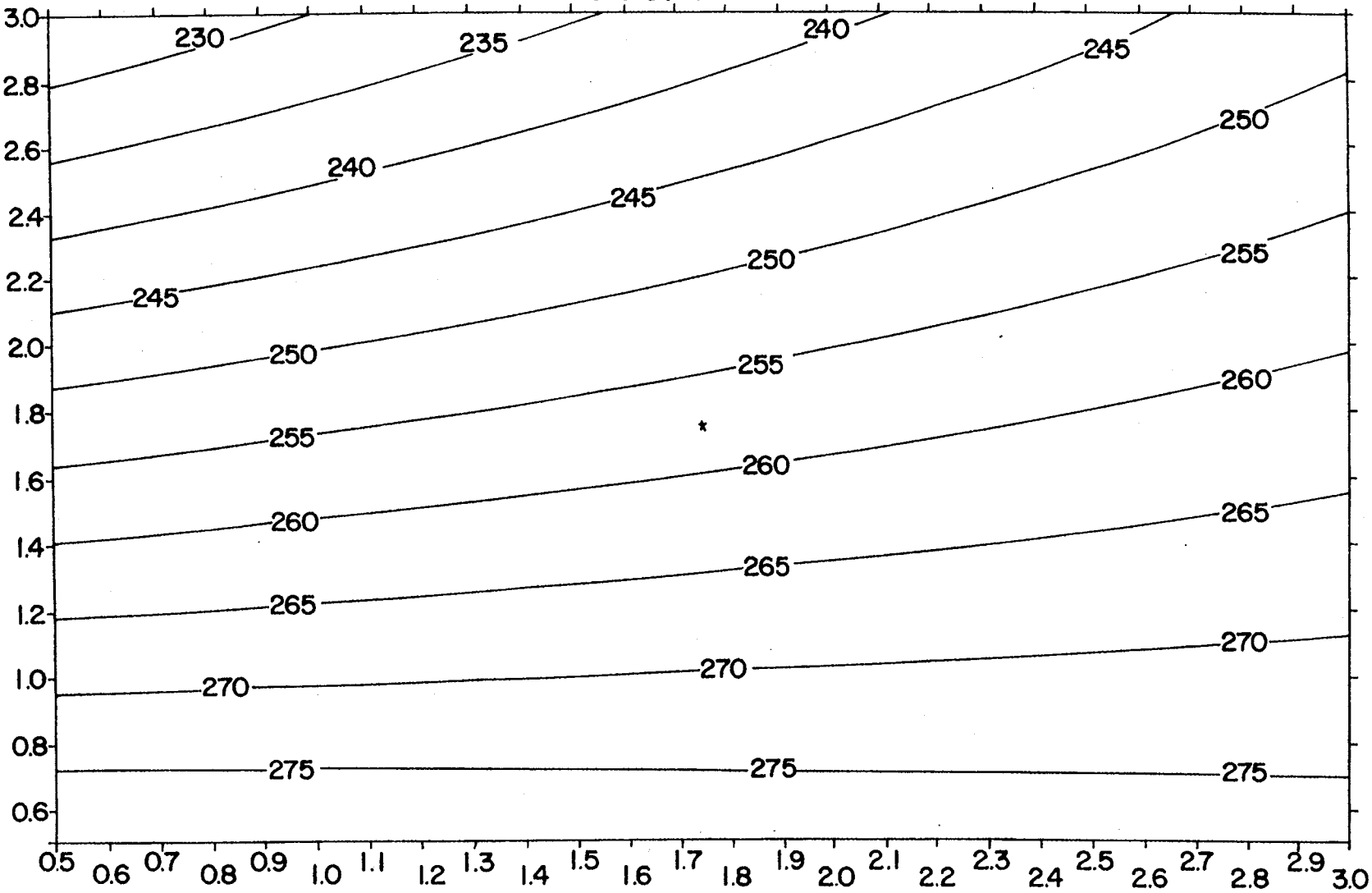
FIG. 7, is a contour plot showing freeness levels or combinations of Cationic B, Anionic B and Liftase A40.
Figure 8:
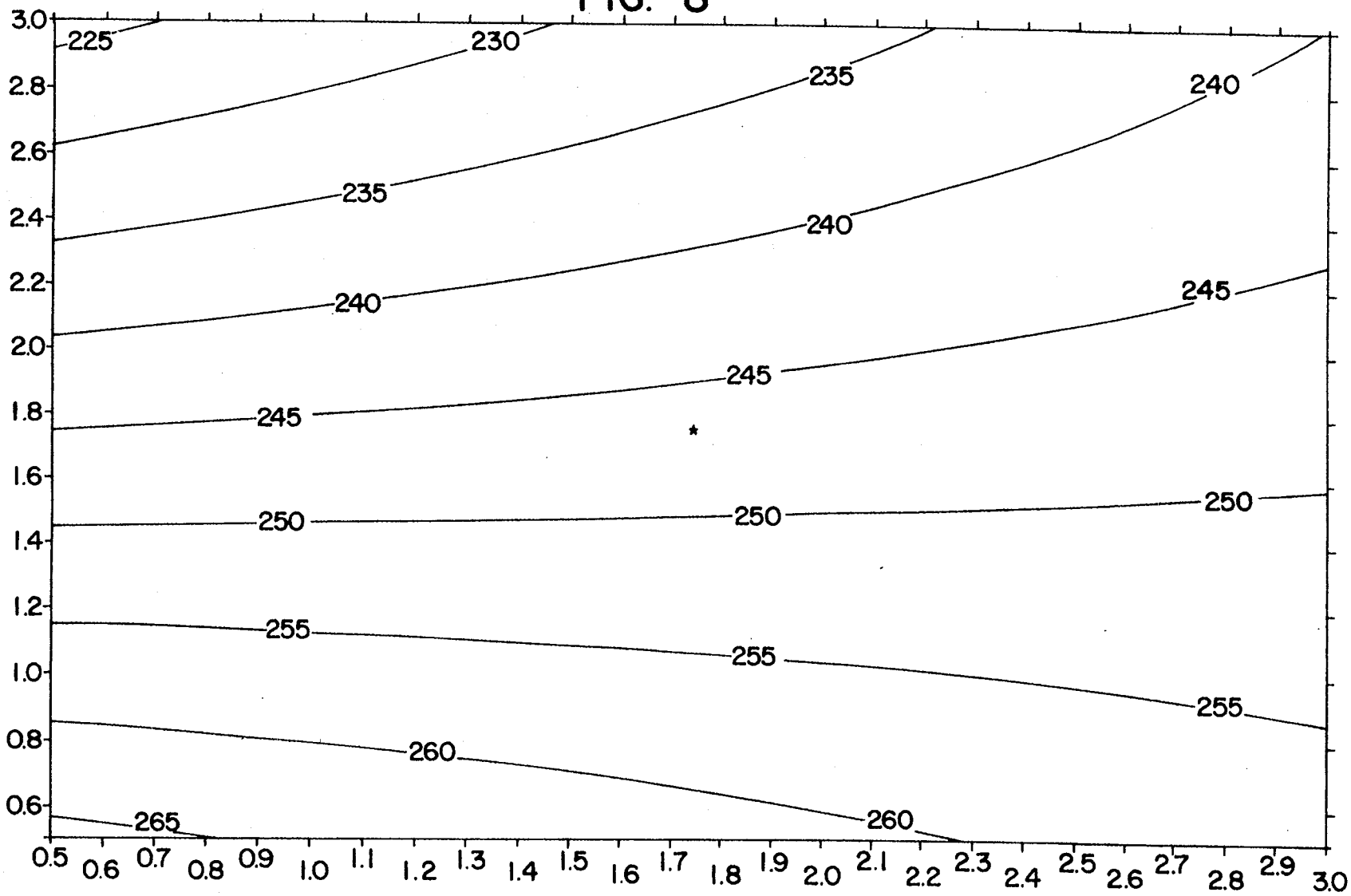
FIG. 8, is a contour plot showing freeness levels or combination of Cationic C, Anionic B and Liftase A40.

These equations were then used to generate contour plots (FIGS. 6, 7, and 8). FIG. 6 shows that when both Cationic A and Anionic B dosages increased beyond one pound product/ton dry pulp, the freeness of pulp began to increase dramatically. At high dosages of each cationic and anionic polymer (3.0 pounds each polymer as product/ton dry pulp) the freeness increased from 202 mL to 642 mL. FIGS. 7 and 8 show no significant increase in freeness when the dosages of each cationic polymer (B and C) and anionic polymer (Anionic B) increased to 3.0 pounds polymer as product/ton dry pulp.

These results could be due to either differences in the chemistries of cationic polymers or lower polymer actives (15%) in B and C respectively, versus 45% in A.

EXAMPLE 5

Figure 9:
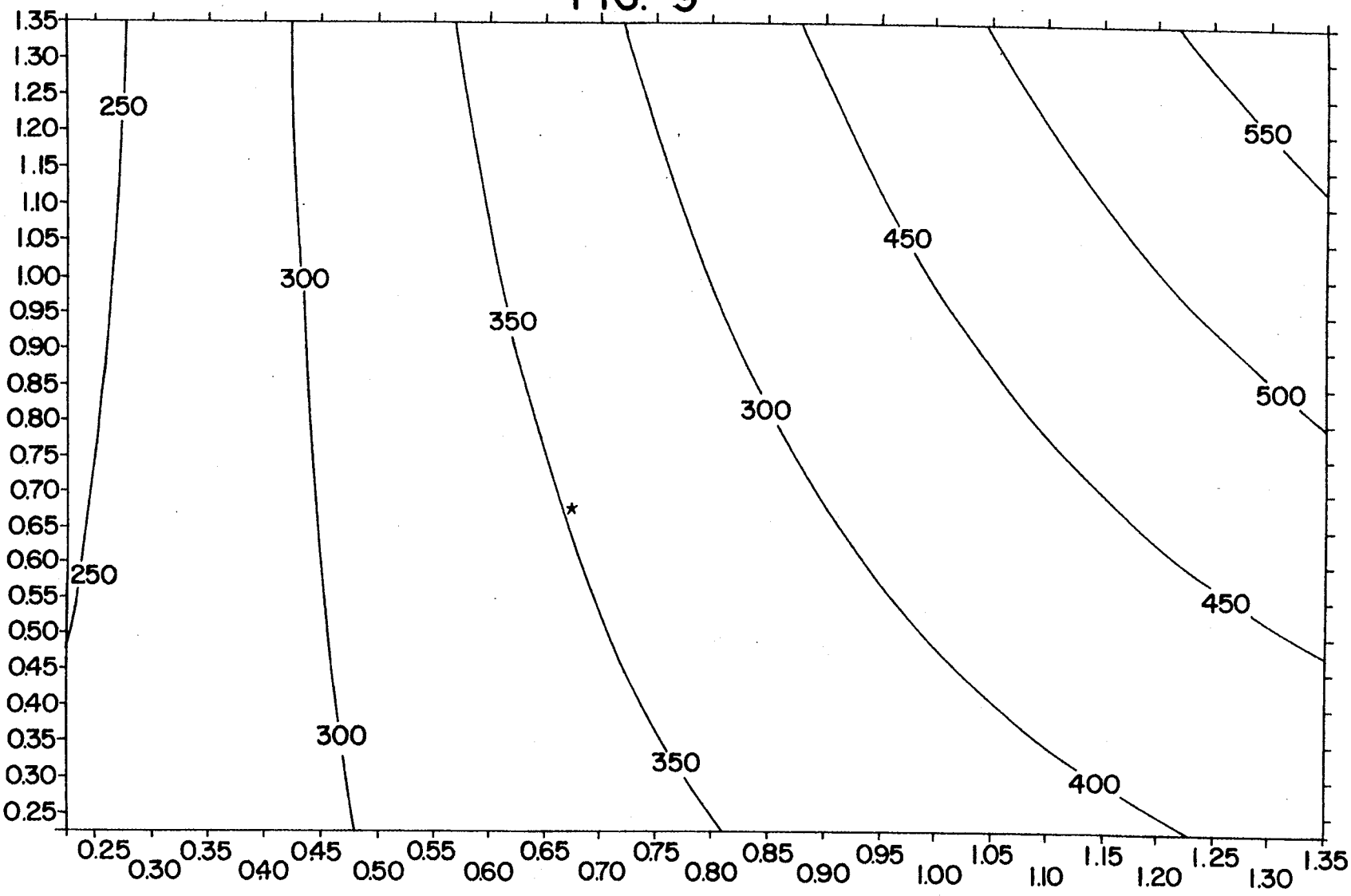
FIG. 9, is a contour plot showing the freeness level achieved by a combination of Cationic A, Anionic B and Lifiase A40.
Figure 10:
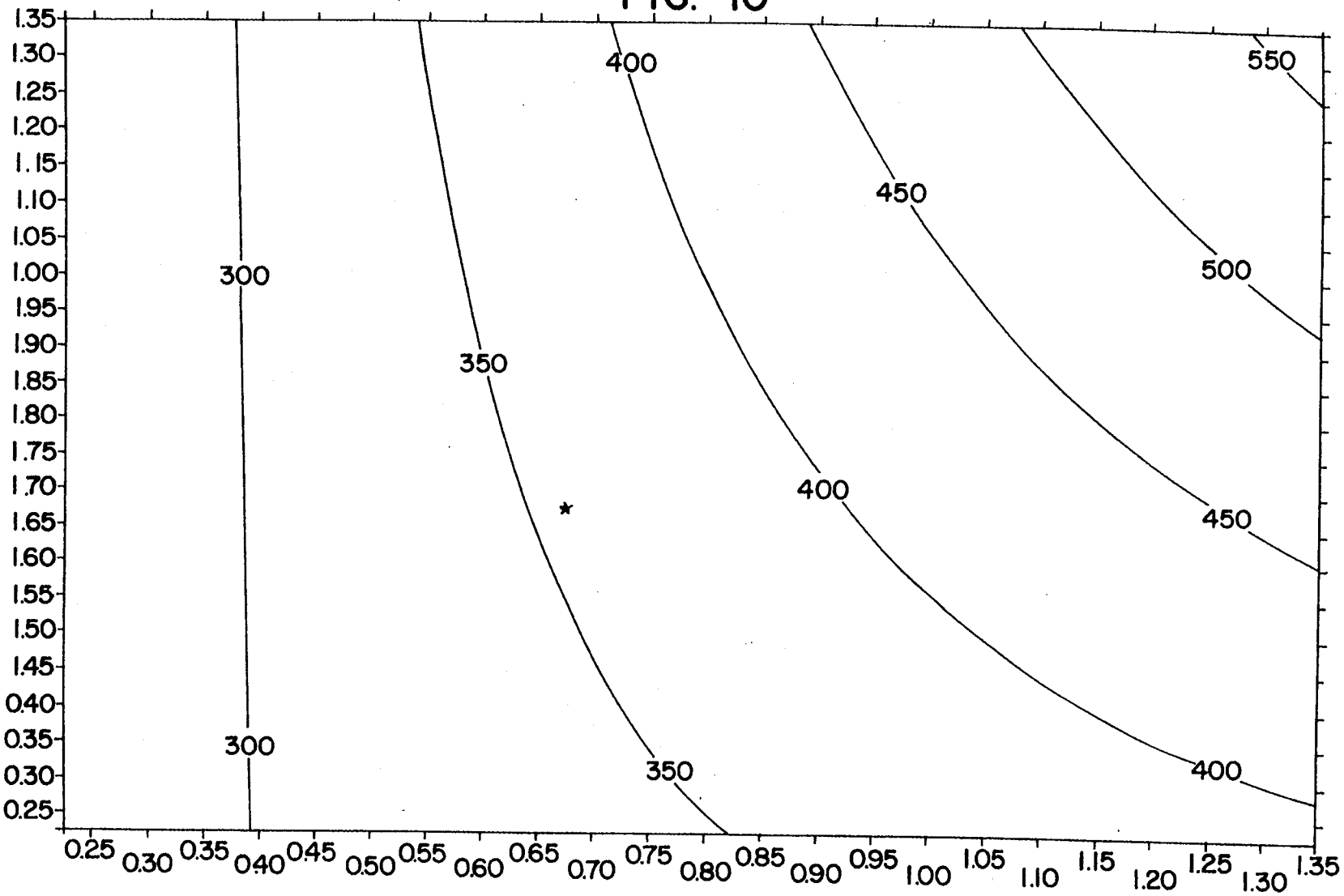
FIG. 10, is a contour plot showing the effect on the levels of freeness achieved by a combination of Cationic B, Anionic B and Liftase A40.
Figure 11:
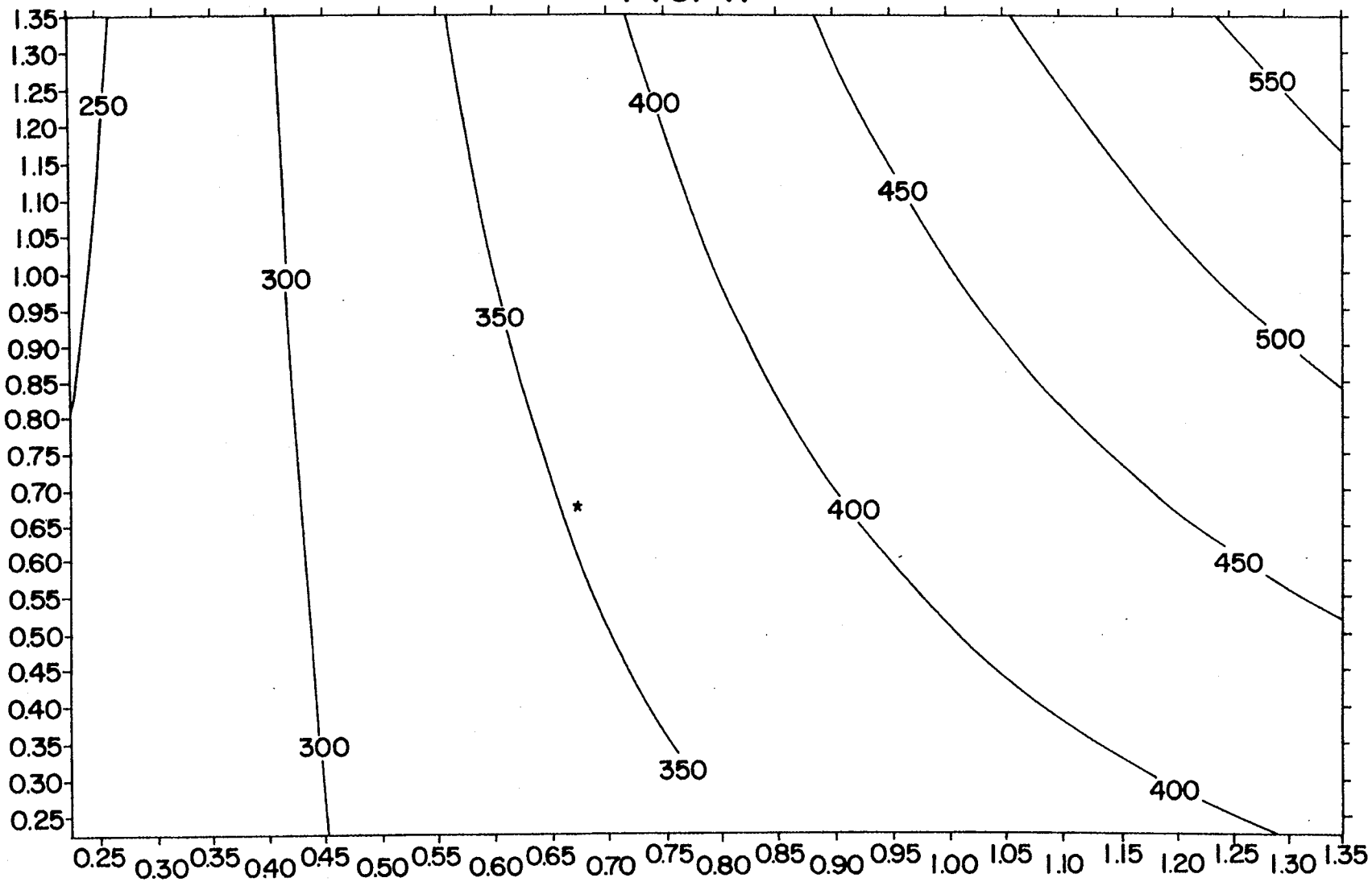
FIG. 11, is a contour plot showing the freeness achieved by a combination of Cationic C, Anionic B and Liftase A40.

To explain the results of Example 4, a separate experiment as described below was carried out. In this experiment, the performance of these polymers was investigated at equal polymer active basis. An eighteen-run response surface design (Table VII) was performed in which the effect of varying the chemistry of the cationic polymers (A, B, and C) and Anionic polymer B in the presence of Liftase-A40, on the freeness of pulp was investigated. The pulp slurry was first treated under optimal conditions with Liftase-A40 (0.2% based on dry weight of pulp) and then treated sequentially for 2.0 min. at 20° C. with equal active dosages of cationic polymers (0.225 to 1.350 pounds polymer/ton dry pulp) and an anionic polymer (Anionic B, 0.225 to 1.35 pound/polymer/ton dry pulp). The experimental data given in Table VII was used to develop a predictive equation which was used to generate contour plots (FIGS. 9, 10, and 11).

TABLE VII

Evaluation of Dual Polymer Program Using Equal Actives

| 0 | 1 Ord | 2 Cationic Type | 3 Cationic Dose As Active | 4 Anionic Dose As Active | 5 CSF |
|---|---|---|---|---|---|
| 1 | 1 | CATIONIC B | 0.675 | 0.675 | 368 |
| 2 | 2 | CATIONIC C (EDC-AMMONIA) | 0.225 | 0.225 | 268 |
| 3 | 3 | CATIONIC A | 0.225 | 0.225 | 266 |
| 4 | 4 | CATIONIC A | 0.675 | 0.675 | 330 |
| 5 | 5 | CATIONIC B | 0.225 | 1.350 | 250 |
| 6 | 6 | CATIONIC A | 0.225 | 1.350 | 238 |
| 7 | 7 | CATIONIC B | 1.350 | 0.225 | 388 |
| 8 | 8 | CATIONIC C (EDC-AMMONIA) | 0.675 | 0.675 | 366 |
| 9 | 9 | CATIONIC C (EDC-AMMONIA) | 0.225 | 1.350 | 231 |
| 10 | 10 | CATIONIC C (EDC-AMMONIA) | 1.350 | 0.225 | 412 |
| 11 | 11 | CATIONIC A | 1.350 | 0.225 | 408 |
| 12 | 12 | CATIONIC A | 1.350 | 1.350 | 600 |
| 13 | 13 | CATIONIC C (EDC-AMMONIA) | 1.350 | 1.350 | 575 |
| 14 | 14 | CATIONIC B | 1.350 | 1.350 | 555 |
| 15 | 15 | CATIONIC C (EDC-AMMONIA) | 0.675 | 0.675 | 363 |
| 16 | 16 | CATIONIC B | 0.225 | 0.225 | 260 |
| 17 | 17 | CATIONIC A | 0.675 | 0.675 | 335 |
| 18 | 18 | CATIONIC B | 0.675 | 0.675 | 365 |

It is shown (FIGS. 9, 10 and 11) that when both cationic and anionic polymer dosages increased beyond 0.45 pounds active polymer/ton dry pulp the freeness of pulp began to increase dramatically. At high dosages (1.35 pounds active polymer/ton dry pulp) of cationic polymers (A, B and C) and anionic polymer (Anionic B) the freeness increased from 202 ml (control) to 600, 555 and 575 ml respectively. The shape and the trends of contour plots generated for each cationic polymer with Anionic B were so similar that they could be easily superimposed. These results suggested that different dual polymer programs can be used with enzyme for achieving high freeness of recycled fiber.

We claim:

1. A process for improving the freeness of paper pulp, which comprises the sequential steps of:

a) adding to the pulp at least 0.05% based on the dry weight of the pulp, of a cellulolytic enzyme;

b) allowing the pulp to contact the cellulolytic enzyme for from about 30 minutes to about 60 minutes at a temperature of at least 40° C;

c) adding at least 0.011% based on the dry weight of the pulp of a water-soluble cationic polymer;

d) adding at least 0.007% based on the dry weight of the pulp of a water soluble polymer selected from the group consisting of acrylamide/acrylic acid (anionic polymer); and e) forming the thus treated pulp into paper.

2. The process of claim 1, wherein the water soluble cationic polymer is a copolymer which contains from 20% to 80% by weight of acrylamide.

3. The process of claim 2, wherein the cationic acrylamide copolymer is an acrylamide-diallyldimethyl ammonium chloride copolymer.

4. The process of claim 1, wherein the anionic polymer is an acrylamide polymer comprising from about 20 to 95% acrylamide and from about 5 to 80% anionic monomer by weight of the polymer.

5. The process of claim 4, wherein the anionic polymer is selected from the group consisting of acrylic acid and methacrylic acid.

* * * * *